United States Patent [19]

Husted

[11] Patent Number: 4,930,403

[45] Date of Patent: Jun. 5, 1990

[54] DIRECTIONALLY CONTROLLED HYDRAULIC CYLINDER

[76] Inventor: Royce Husted, 711 Lakeside Dr., Wheaton, Ill. 60187

[21] Appl. No.: 297,551

[22] Filed: Jan. 13, 1989

[51] Int. Cl.[5] ..... F15B 11/08

[52] U.S. Cl. ..... 91/443; 91/461; 91/462; 91/463; 91/466; 91/469; 92/169.1

[58] Field of Search ..... 91/423, 466, 469, 462, 91/463, 460, 443, 461; 92/144, 169.1, 169.2

[56] References Cited

U.S. PATENT DOCUMENTS

| | | | |
|---|---|---|---|
| 121,364 | 11/1871 | Heath | 91/466 |
| 183,909 | 10/1876 | Curtis | 91/466 |
| 501,581 | 7/1893 | Smith | 91/466 X |
| 528,227 | 10/1894 | Holmgren | 91/466 |
| 721,661 | 3/1903 | Bower | 91/423 X |
| 1,954,379 | 4/1934 | Eller | 91/423 X |
| 2,810,370 | 10/1957 | Fox et al. | 91/423 X |
| 3,811,367 | 5/1974 | Bimba | 92/169.1 X |
| 3,881,401 | 5/1975 | Bimba | 92/169.1 |
| 4,073,311 | 2/1978 | McGeachy | 91/443 X |
| 4,475,442 | 10/1984 | Breeden | 91/461 |
| 4,559,863 | 12/1985 | Storey | 91/469 X |

*Primary Examiner*—Edward K. Look

*Attorney, Agent, or Firm*—Nicholas A. Camasto

[57] ABSTRACT

A directionally controllable air cylinder has a set of circumferentially disposed air passages formed at each end of a closed tube. A sleeve manifold surrounds the tube and is pneumatically sealed thereto by means of a plurality of O-rings. The O-rings are positioned such that they selectively expose the sets of air passages to the manifold for receiving compressed air and to the atmosphere for venting. The direction of piston movement is determined by the set of passages exposed to compressed air. A pilot piston moves the manifold in response to a pilot air signal in one embodiment and an electrically operated solenoid moves it in another version. The manifold may also be manually or mechanically moved to operate the air cylinder. Hydraulic cylinders utilizing fluids, other than air, are also disclosed.

12 Claims, 3 Drawing Sheets

DIRECTIONALLY CONTROLLED HYDRAULIC CYLINDER

BACKGROUND OF THE INVENTION AND PRIOR ART

This invention relates generally to low pressure hydraulic cylinders and particularly to hydraulic cylinders of the pneumatic type that are directionally controllable by the application of a compressed medium, such as air, to a piston. While the invention will be described in conjunction with an air cylinder, it will be appreciated that it is equally applicable to any type of low pressure hydraulic cylinder having suitable well known modifications to provide a closed system for the hydraulic fluid.

Pneumatic cylinders are well known in the art for mechanically positioning levers and gears in response to control signals or other inputs and for moving objects. They are extensively used in industrial machinery and packaging equipment. The air cylinder generally comprises a cylindrical tube or body, within which a piston is movable. The body has end portions or caps that close off the cylinder and have one or more air fittings for admitting compressed air to move the piston within the body. A threaded bolt for mounting the cylinder to a base or other suitable mounting device is generally affixed to one end cap. The piston has seals for maintaining pneumatic pressure within the body during operation. The other end cap may contain a suitable bearing for supporting a piston rod that is attached to the piston, for smooth movement. In a single acting cylinder, the piston is biased toward one end by an internal spring. In a double acting cylinder, the piston is freely movable back and forth and its direction is controlled by applying compressed air to different sides of the piston. Such cylinders have two air inlet fittings.

An air cylinder arrangement must include some means for controlling air flow to the body. This is generally accomplished with an air valve that, in turn, is operated by some type of control signal on control input. Control of an air cylinder may be accomplished mechanically, electrically, or pneumatically. In a simple mechanical arrangement, the air valve may be activated by a cam or triple lever on a moving object to direct or control compressed air flow. In an electrical control system, a solenoid actuates the valve to control the air flow in response to a switch or relay closure. In a pneumatic control system, a pilot cylinder is supplied with low pressure air to actuate the valve mechanism which, in turn, controls air flow to the cylinder.

The air cylinder bodies are generally fabricated of relatively thin material. If the body is of stainless steel, the body wall may be extremely thin and prone to damage from accidental contact with other objects. Any disruption of the body wall negatively affects cylinder operation because the piston needs a smooth interior cylindrical surface to function. It is not unusual for a manufacturer to provide an outer protective sleeve for air cylinders intended for use in a hostile environment, i.e., where the likelihood of physical damage is high. The protective sleeve for the cylinder body is usually made of thick aluminum to provide physical protection for the relatively thin wall air cylinder.

Use of an air cylinder in such an environment requires not only an air cylinder and control valve assembly, but a protective sleeve for the cylinder body. It should be apparent that the overall cost is increased significantly, especially since the valve is often more expensive than the cylinder and a protective sleeve adds even more cost. Furthermore, a typical installation of an air cylinder and an air control valve involves many fittings, connections and plastic piping and generally takes up significant space. There is clearly a need in the art for a simple, low cost, space efficient, controllable air cylinder mechanism.

OBJECTS OF THE INVENTION

A principal object of the invention is to provide a novel low pressure hydraulic cylinder arrangement.

Another object of the invention is to provide a controllable hydraulic cylinder arrangement of low cost.

A further object of the invention is to provide a low cost rugged controllable low pressure hydraulic cylinder arrangement.

A further object of the invention is to provide a unitary mechanically protected controllable air cylinder arrangement.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 1:
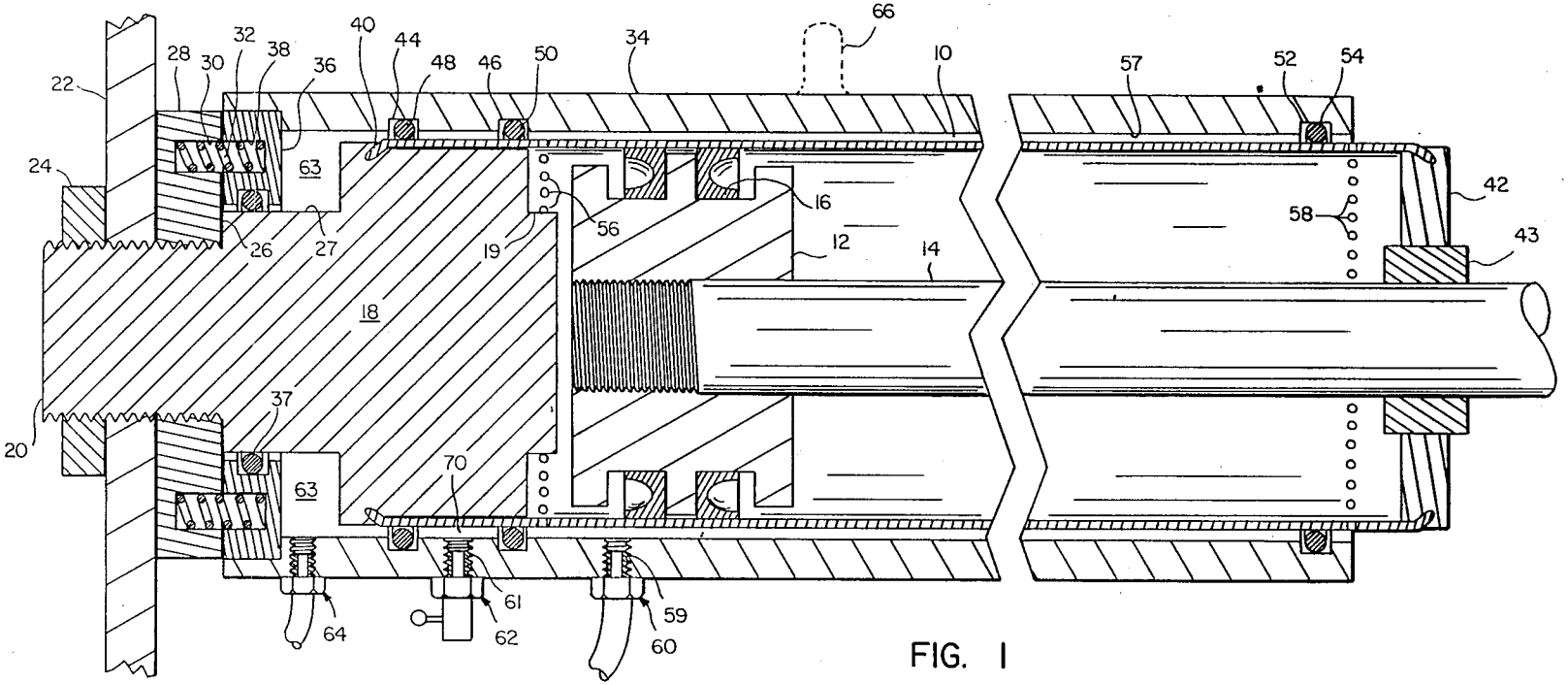
FIG. 1 is a cross section of a controllable air cylinder constructed in accordance with the invention.
Figure 2:
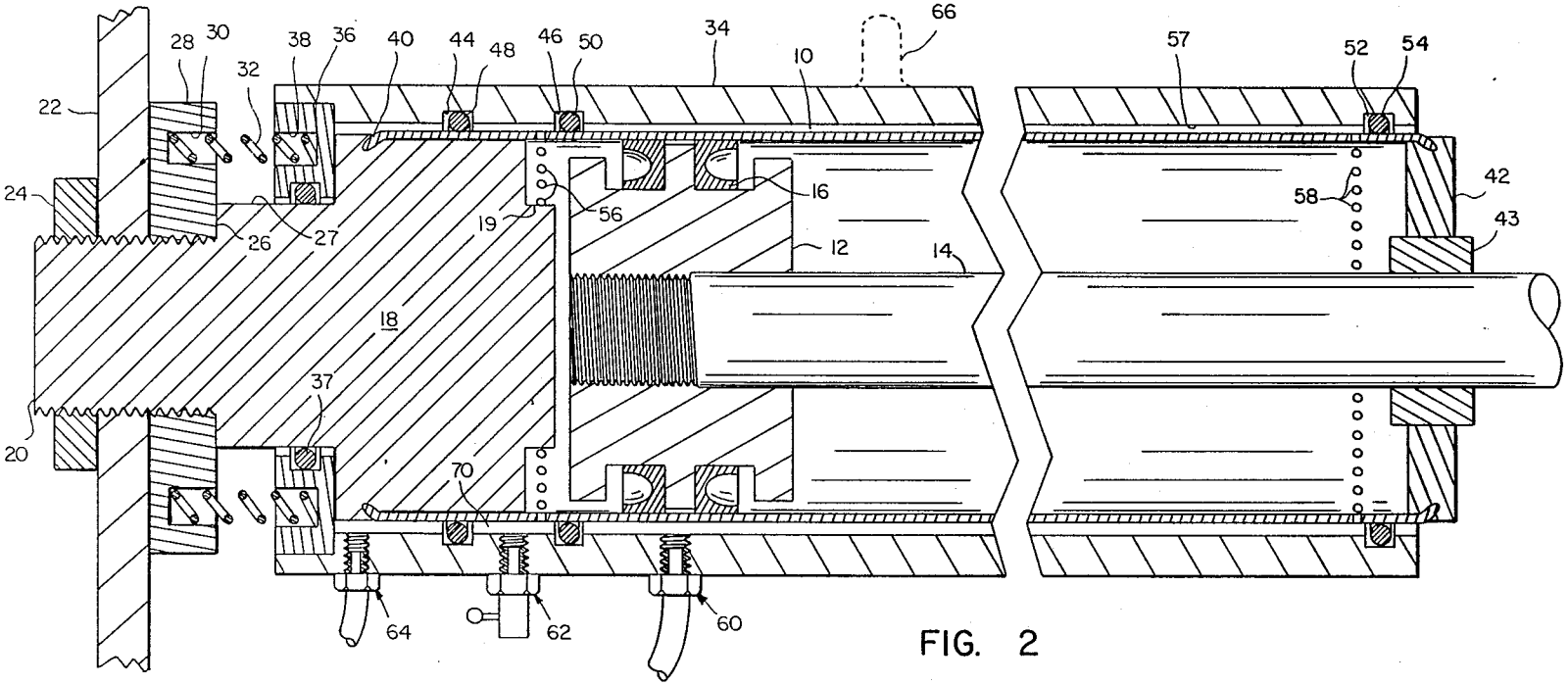
FIG. 2 is a cross section of the air cylinder of FIG. 1 in a different operating condition.

Referring to FIGS. 1 and 2, a cross section of a directionally controllable air cylinder constructed in accordance with the invention is illustrated. FIG. 1 illustrates the energizing position and FIG. 2 illustrates the rest position. The air cylinder includes a relatively thin tube or body 10 and a piston 12 that carries a control rod 14 mounted for axial movement therein. A lip sealed 16 extends around the periphery of the piston 12 and forms a movable air tight seal with the inner surface of tube 10. The seal 16 enables piston 12 to be driven back and forth within tube 12 by selective application of air pressure to the sides of piston 12, as will be described . An end cap or portion 18, having a threaded extension 20 for mounting the air cylinder to a surface, such as surface 22, by means of a nut 24 is provided. The end cap 18 and tube 10 may be secured together by, for example, a double rolled seal, as illustrated at 40. The other end of tube 10 is closed by an end cap 42 that has a central bearing 43 mounted therein for supporting control rod 14 for axial slidable movement. End cap 18 has a shoulder 19 formed thereon which, like the inner extension of bearing 43, provides a stop for piston 12. A spring support plate 28 is secured to threaded extension 20 and includes a number of recesses 30, two of which are shown, for supporting a similar number of compression springs 32. A doughnut-shaped pilot piston 36 has a similar facing recesses 38 that cooperates with recesses 30 to captivate springs 32.

Pilot piston 36 is affixed to a cylindrical sleeve that surrounds tubes 10. Sleeve 34 may be constructed of heavy gauge metal, if required, to provide protection for tube 10. A plurality of circumferential channels or grooves 44, 46 and 52 are formed in the inner surface of sleeve 34 and O-rings 48, 50 and 54, respectively, are secured therein. The O-rings form seals between the inner surface of sleeve 34 and the outer surface of tube 10. Two groups of circumferentially disposed air passageways 56 and 58 are disposed adjacent each end of the tube 10. The volume defined by O-rings 50 and 54, the inner wall of sleeve 34 and the out surface of tube 10 forms a movable manifold 57. A hole 59 is formed in sleeve 34 and a fitting 60 is affixed therein for supplying compressed air to manifold 57. With sleeve 34 in the position shown in FIG. 2, compressed air enters manifold 57 through fitting 60 in sleeve 34, passes through passageways 58 in tube 10 and pressurizes the right side of piston 12, which drives it into its rest position substantially as shown.

FIG. 1 shows the activated position of the air cylinder with piston 12 just beginning to move to the right. It is noted that the pilot piston 36 has compressed springs 32 and is adjacent to spring support plate 28. Pilot piston 36 has been moved by air admitted by a fitting 64 affixed to another hole 63 in sleeve 34. Compressed air for operating the pilot piston 38 is of much lower pressure and the piston area is small. A much smaller line is used to supply air to operate the pilot piston. Pilot piston 36 has a peripheral O-ring 37 that forms a seal with cylindrical surface 27 on end cap 18 and, when pressurized, moves against the force of springs 32. In so doing, sleeve 34, which is attached to pilot piston 36, moves to the left. Volume 63 results from this movement of the pilot piston.

Sleeve 34 in moving to the left forces O-ring 50 to move to the left of air passageways 56 and thus expose passageways 56 to air pressure in manifold 57. Simultaneously, O-ring 54 exposes passageways 58 to atmosphere, thus venting the pressurized air in tube 10 to the atmosphere. Compressed air flows from manifold 57, through air holes 56 and pressurizes the left side of piston 12. Since the right of piston 12 is vented to the atmosphere, piston 12 (and control rod 14) is driven to the right.

A vent port 61 is also formed in sleeve 34. An adjustable vent fitting 62 is affixed in port 61. A volume 70, defined by the inner surface of sleeve 34, the outer surface of tube 10 and O-rings 48 and 50 is in communication with vent port 61. As best shown in FIG. 2, pressurized air that is exhausted through passageways 56 as the piston 12 moves to the left escapes through vent port 61 and adjustable vent fitting 62. By restricting the airway through adjustable vent fitting 62, the rate at which the air is exhausted from tube 12 may be closely controlled. Consequently, the rate of movement of piston 12 may be controlled. Thus a control on the rate at which piston 12 moves to the left is provided. A similar controlled venting arrangement may readily be provided for air passageways 58 if desired.

Figure 3:
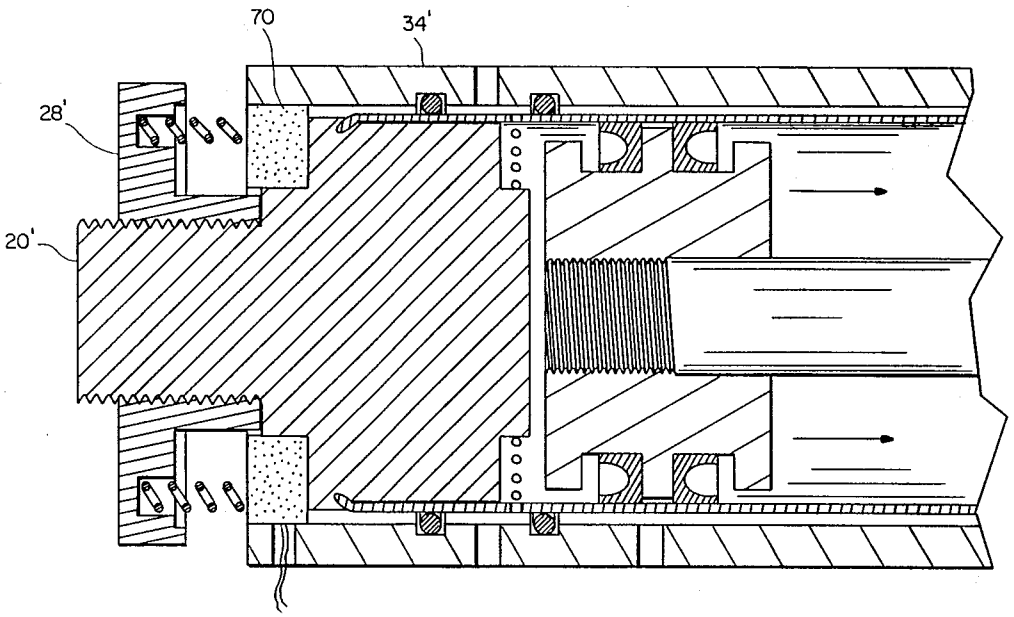
FIG. 3 is a partial cross section of an electrically operated air cylinder in the deactivated position.

In FIG. 3, an electrically operated pilot arrangement for moving a sleeve 34' is shown. The solenoid 70 is shown in schematic form only since it is quite conventional in the art. Solenoid 70 is affixed to sleeve 34' and when energized, is attracted toward a steel end cap 28'. In such an embodiment, rear stud mount 20' is made of aluminum. Suffice it to say that the sleeve 34' is moved in response to actuation of solenoid 70 to supply compressed air to the appropriate set of air passages 56 and 58. A conventional spring return is provided.

The size of the individual air passages 56 and 58 should be quite small in comparison to the cross sectional diameters of the O-rings 44, 46 and 54 to facilitate moving over the passageways with minimum wear. End boots are not required, but may be used in particularly dusty or contaminant-filled locations. The sleeves 34 and 34' may, of course, be manually moved to operate the piston 12, which permits simple testing of installed units. The particular air cylinder configuration is selected to illustrate the basic principles of the movable manifold, directionally controllable air valve. Similarly, the mounting arrangement is illustrative only.

For a fluid hydraulic version of the cylinder arrangement, a pressurized hydraulic medium, such as oil, would be supplied by a pump and provision made for the hydraulic fluid to be returned to a sump. Both ends of the body would be fitted with double O-rings with the supply fitting coupled to the pump and the vent fitting coupled to the sump.

What has been described is a novel air cylinder arrangement in which a sleeve is movable over the air cylinder body for controlling air flow to the piston. It is recognized that numerous changes in the described embodiments of the invention will be apparent to those skilled in the art without departing from its true spirit and scope. The invention is to be limited only as defined in the claims.

What is claimed is:

1. In combination:

a cylindrical body having a plurality of air passageways at at least one end;

a piston movable within said body;

a cylindrical sleeve overlying said cylindrical body and mounted for movement along said body;

a pair of seal means for forming a manifold between said cylindrical sleeve and said cylindrical body;

an inlet in said cylindrical sleeve between said pair of seal means for admitting compressed air to said manifold; and said seal means being positioned to selectively expose said passageway to said compressed air for moving said piston.

2. The combination of claim 1, further including spring means urging said sleeve to a given position on said body.

3. The combination of claim 2, further including means coupled to said sleeve for moving said sleeve on said body.

4. The combination of claim 3 wherein said last mentioned means is mechanically operated.

5. The combination of claim 3 wherein said last mentioned means is electrically operated.

6. The combination of claim 3 wherein said last mentioned means is pneumatically operated.

7. An air cylinder comprising:

a body having air passageways at at least one end;

a piston axially movable within said body;

an exterior protective sleeve overlying said body;

a pair of seals pneumatically sealing said body and said sleeve and forming a manifold between said body and said sleeve, said sleeve being movable over said body to displace said manifold and selectively admit air from said manifold through said air passageways to the faces of said piston;

an air inlet coupled to said sleeve between said seals for admitting compressed air to said manifold and means coupled to said sleeve for enabling movement of said sleeve with respect to said body.

8. The cylinder of claim 7, further including adjustable vent means in said sleeve for controlling expulsion of air from said body when said piston is moving.

9. An air cylinder comprising:

a cylindrical body having a plurality of small air passageways at at least one end;

a piston movable within said body;

an external cylindrical sleeve overlying said body and mounted for movement along said body;

a pair of seals pneumatically sealing said body and said cylindrical sleeve and forming a movable manifold between said body and said sleeve for selectively admitting air from said manifold through said air passageways to the faces of said piston;

an air inlet-in said sleeve for admitting compressed air to said manifold; and solenoid means coupled to one of said body and said sleeve for relatively moving said sleeve and said body.

10. The combination of claim 9, further including adjustable vent means in said sleeve for controlling the exit of air from one side of said piston when the other side of said piston is supplied with compressed air.

11. A hydraulic cylinder comprising:

a body having a plurality of generally circular passageways at at least one end;

a piston axially movable within said body;

an exterior sleeve overlying said body and being movable along said body;

a pair of seals hydraulically sealing said body and said sleeve and forming a movable fluid manifold between said body and said sleeve for selectively supplying a pressurized medium from said manifold to the faces of said piston through said passageways;

fluid inlet means in said sleeve for admitting pressurized fluid to said manifold, and means coupled to said sleeve for enabling movement of said sleeve over said body.

12. The cylinder of claim 11 wherein said seals comprise circular O-rings having cross sections that are substantially larger than said passageways to minimize wear.

* * * * *

UNITED STATES PATENT AND TRADEMARK OFFICE

CERTIFICATE OF CORRECTION

PATENT NO. : 4,930,403

DATED : June 5, 1990

INVENTOR(S) : Royce Husted

It is certified that error appears in the above-identified patent and that said Letters Patent is hereby corrected as shown below:

Column 1, line 24, after"and", insert --may--;

line 41, delete "on", insert --or--;

line 45, delete "triple", insert --trip--;

Column 2, line 61, delete "a" (lower case);

Column 3, line 7, delete "out", insert --outer--;

line 38, after "right", insert --side--;

Column 5, line 12, after "inlet", delete the hyphen (-).

Signed and Sealed this

Twentieth Day of August, 1991

*Attest:*

*Attesting Officer*

HARRY F. MANBECK, JR.

*Commissioner of Patents and Trademarks*